US008634737B2

(12) United States Patent
Nakaegawa

(10) Patent No.: US 8,634,737 B2
(45) Date of Patent: Jan. 21, 2014

(54) IMAGE FORMING APPARATUS

(75) Inventor: Tohru Nakaegawa, Nagareyama (JP)

(73) Assignee: Canon Kabushiki Kaisha, Tokyo (JP)

( * ) Notice: Subject to any disclaimer, the term of this patent is extended or adjusted under 35 U.S.C. 154(b) by 231 days.

(21) Appl. No.: 13/196,465

(22) Filed: Aug. 2, 2011

(65) Prior Publication Data

US 2012/0033986 A1 Feb. 9, 2012

(30) Foreign Application Priority Data

Aug. 3, 2010 (JP) ..... 2010-174548

(51) Int. Cl.
*G03G 15/00* (2006.01)
*G03G 21/00* (2006.01)

(52) U.S. Cl.
USPC ..... 399/71; 399/350; 399/358

(58) Field of Classification Search
USPC ..... 399/71, 350, 353, 356, 357, 358, 346, 399/360, 349
See application file for complete search history.

(56) References Cited

FOREIGN PATENT DOCUMENTS

JP 08160818 A * 6/1996 ..... G03G 21/10
JP 11-095573 A 4/1999
JP 11-119626 A 4/1999
JP 11-219040 A 8/1999
JP 2004361776 A * 12/2004 ..... G03G 21/10
JP 2007-108333 A 4/2007

OTHER PUBLICATIONS

Translation of Ueda, 2004-361776.*
Machine translation of Nakayama, 08-160818 (1996).*

* cited by examiner

*Primary Examiner* — David Gray
*Assistant Examiner* — Sevan A Aydin
(74) *Attorney, Agent, or Firm* — Fitzpatrick, Cella, Harper & Scinto

(57) ABSTRACT

An image forming apparatus includes an image bearing member; toner image forming portion for forming a toner image on the image bearing member; a transfer member for transferring the toner image from the image bearing member onto a transfer material; a cleaning blade for removing a toner remaining on the image bearing member after transfer while being contacted to the image bearing member; a rotatable member, provided upstream of the cleaning blade, for carrying the toner and rotationally sliding on the image bearing member; a separating mechanism for removing the toner from the rotatable member in contact with the rotatable member, wherein the separating mechanism includes a toner sump for accumulating the toner in an area adjacent to the rotatable member so that the toner removed from the rotatable member is suppliable to the rotatable member; and a controller for controlling at least one of the toner image forming portion and rotatable member so that an amount of the toner in the toner sump is estimated and kept in a predetermined range.

7 Claims, 14 Drawing Sheets

(a)

(b)

IMAGE FORMING APPARATUS

FIELD OF THE INVENTION AND RELATED ART

The present invention relates to an image forming apparatus in which a rotatable member on which a toner is carried is rotated and slid on an image bearing member at an upstream side of a cleaning blade. Specifically, the present invention relates to control of toner supply to the cleaning blade.

The image forming apparatus in which a toner image carried on the image bearing member (photosensitive member or intermediary transfer member) is transferred onto a recording material at a transfer portion and then is heat-fixed has been widely used. At downstream side of the transfer portion, a cleaning device is provided. Untransferred toner which passes through the transfer portion and then is deposited on a surface of the image bearing member is removed (scraped) and collected by a cleaning blade of an urethane rubber or the like. When the toner is stagnated in an appropriate amount at a contact portion between the cleaning blade and the image bearing member, a friction state is stabilized and a degree of speed non-uniformity of the image bearing member is decreased, so that a driving load is also reduced and an electric discharge product can be efficiently removed together with the toner.

Japanese Laid-Open Patent Application (JP-A) Hei 11-95573 discloses cleaning blade toner supply control in which a band-like toner image is formed on a photosensitive drum during non-image formation and is supplied to a contact portion between the photosensitive drum and the cleaning blade.

JP-A Hei 11-219040 discloses cleaning blade toner supply control in which the band-like toner image is transferred onto an intermediary transfer belt immediately before stop and the intermediary transfer belt is stopped in a state in which the band-like toner image is sent to a contact portion between the intermediary transfer belt and the cleaning blade.

JP-A Hei 11-119626 discloses cleaning blade toner supply control in which a sliding load of the cleaning blade is detected to measure a toner amount at a contact portion and only in the case where the toner amount at the contact portion is excessively small, the band-like toner image is formed on the photosensitive drum.

Incidentally, a cleaning device including a cleaning blade and a rotatable member (brush member or roller member) on which the toner is carried, in which the rotatable member is rotated at an upstream side of the cleaning blade to cause the toner to slide on the image bearing member has been put into practical use. In JP-A 2007-108333, a fur brush on which the toner is carried is rotated at the upstream side of the cleaning blade to apply and diffuse the toner onto the surface of the photosensitive drum, so that a friction state of the cleaning blade with respect to a longitudinal direction is stabilized. Further, the fur brush on which the toner is carried is slid on the photosensitive drum, so that an electric discharge product removing effect is uniformly ensured.

In the cleaning blade toner supply control disclosed in JP-A Hei 11-119626, the amount of the toner stagnated at an end (free end) of the cleaning blade cannot be measured so accurately. This is because a frictional load between the cleaning blade and the photosensitive drum varies largely depending on cumulative operating time of the photosensitive drum and the cleaning blade, a temperature and a humidity, and the immediately preceding image forming condition.

Further, in the image forming apparatus disclosed in JP-A 2007-108333, in order to stabilize a cleaning effect of the cleaning blade, there is a need to constantly ensure not only the toner amount at the cleaning blade end but also the amount of the toner carried on the rotatable member.

SUMMARY OF THE INVENTION

A principal object of the present invention is to provide an image forming apparatus capable of stably retaining a cleaning effect of a cleaning blade.

According to an aspect of the present invention, there is provided an image forming apparatus comprising:

an image bearing member;

toner image forming means for forming a toner image on the image bearing member; transfer means for transferring the toner image from the image bearing member onto a transfer material;

a cleaning blade for removing a toner remaining on the image bearing member after transfer while being contacted to the image bearing member;

a rotatable member, provided upstream of the cleaning blade, for carrying the toner and rotationally sliding on the image bearing member;

a separating mechanism for removing the toner from the rotatable member in contact with the rotatable member, wherein the separating mechanism includes a toner sump for accumulating the toner in an area adjacent to the rotatable member so that the toner removed from the rotatable member is suppliable to the rotatable member; and control means for controlling at least one of the toner image forming means and rotatable member so that an amount of the toner in the toner sump is estimated and kept in a predetermined range.

These and other objects, features and advantages of the present invention will become more apparent upon a consideration of the following description of the preferred embodiments of the present invention taken in conjunction with the accompanying drawings.

Figure 3:
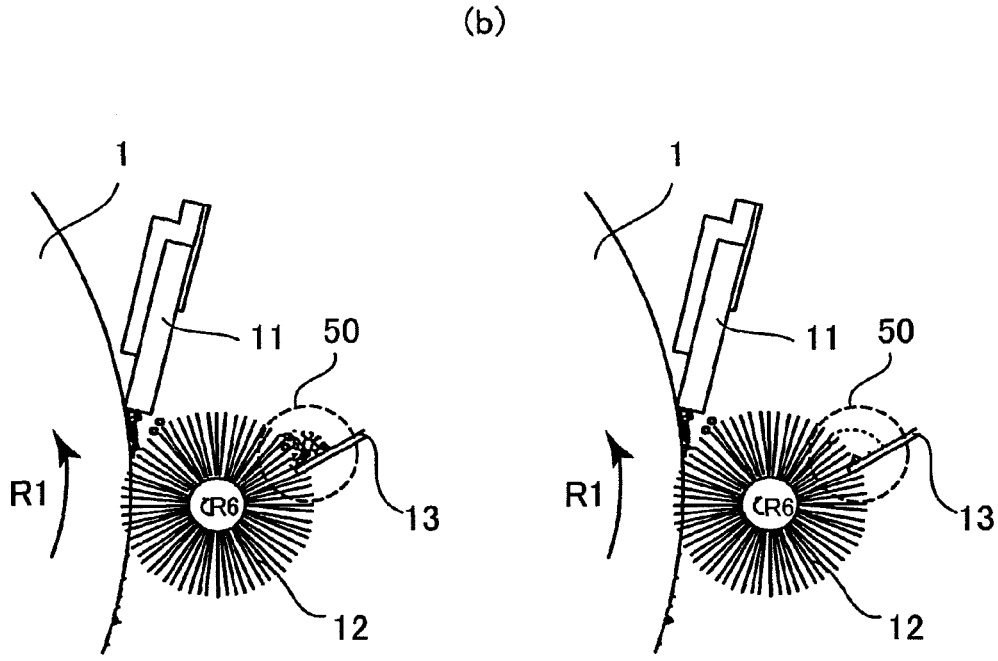

Parts (a) and (b) of FIG. 3 are illustrations of a toner sump.

Figure 4:
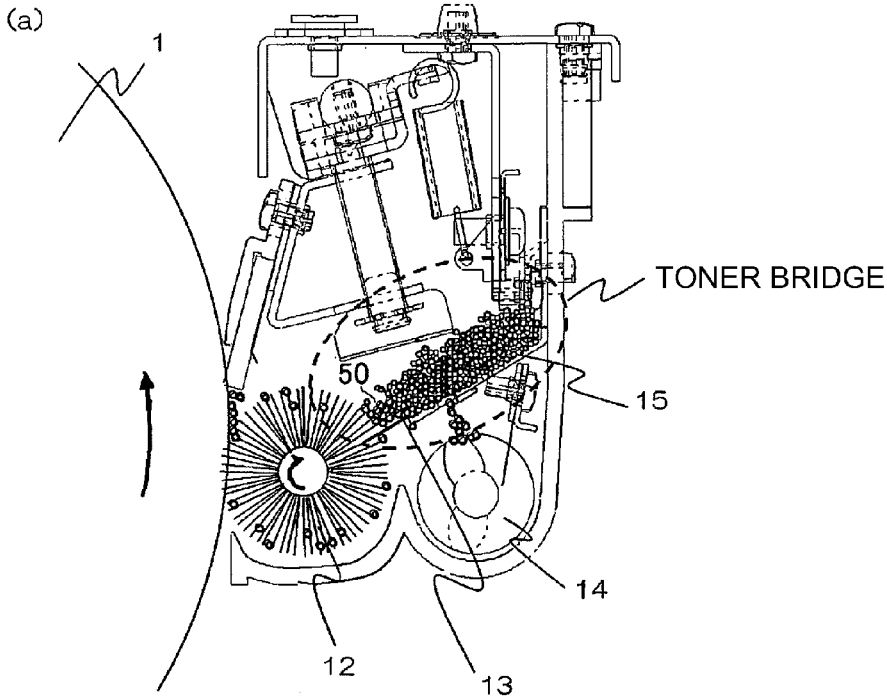
Figure 4:
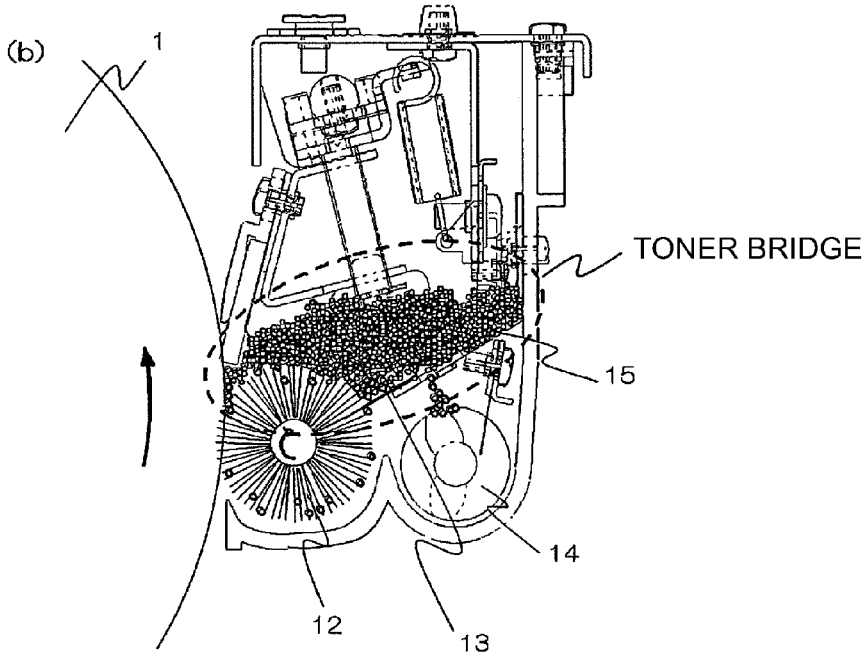

Parts (a) and (b) of FIG. 4 are illustrations of a toner bridging phenomenon.

Figure 5:
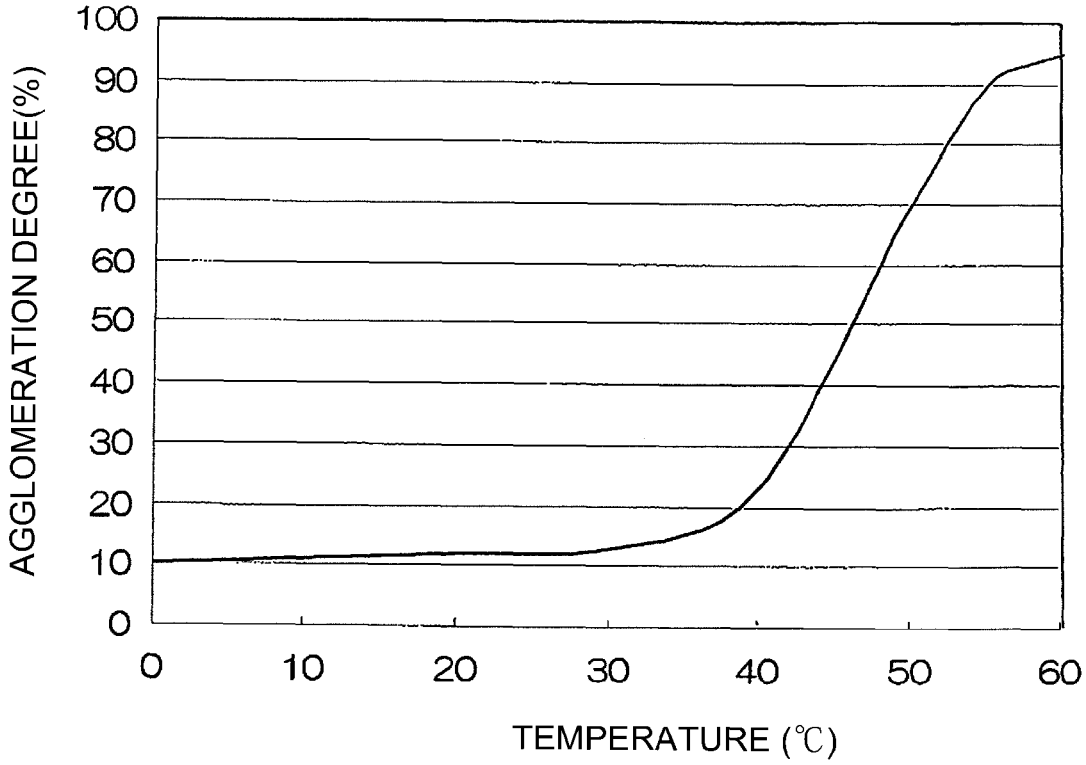

FIG. 5 is a graph showing a relationship between an ambient temperature and a degree of agglomeration.

Figure 6:
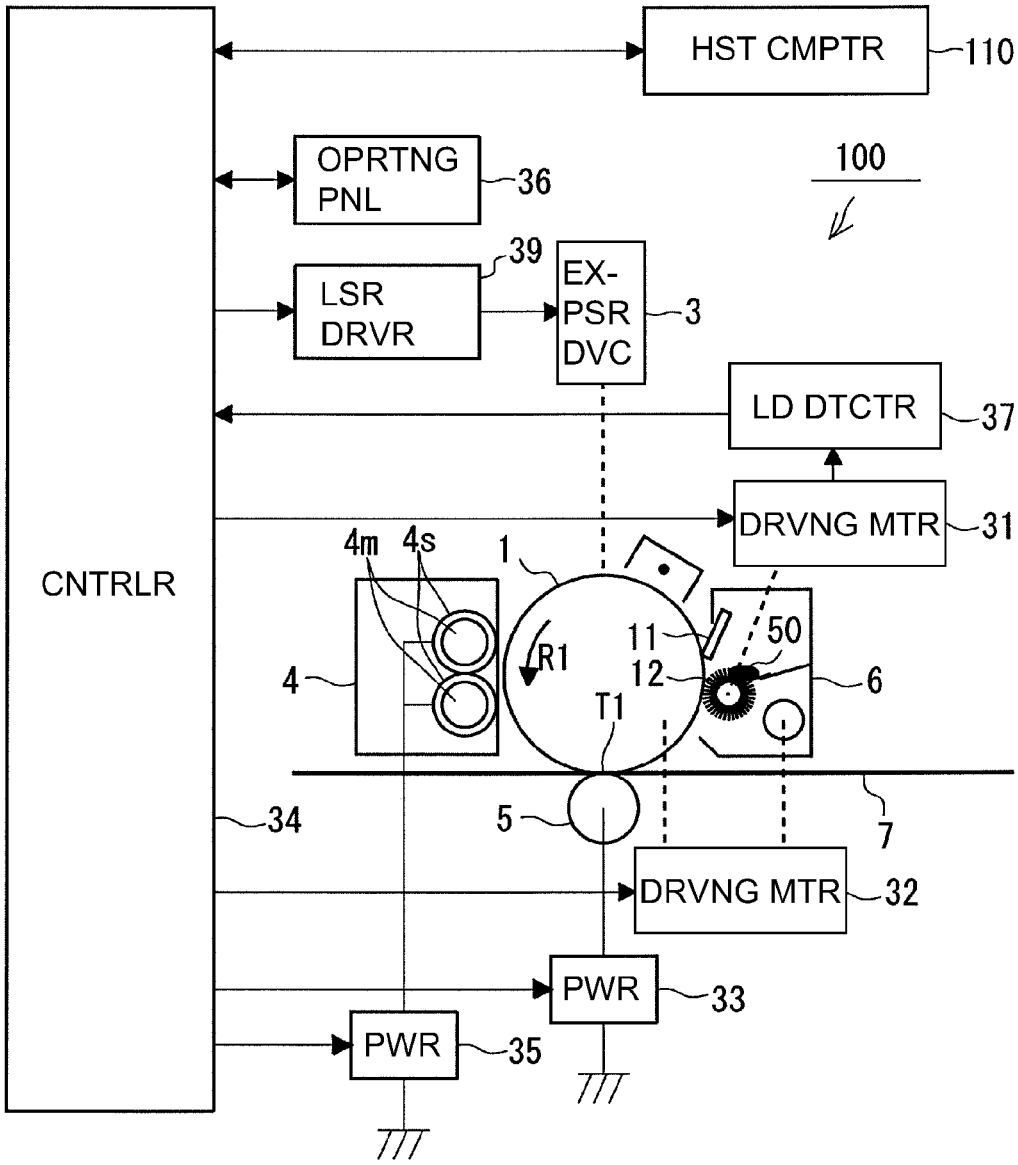

FIG. 6 is a block diagram of a control system in Embodiment 1.

Figure 7:
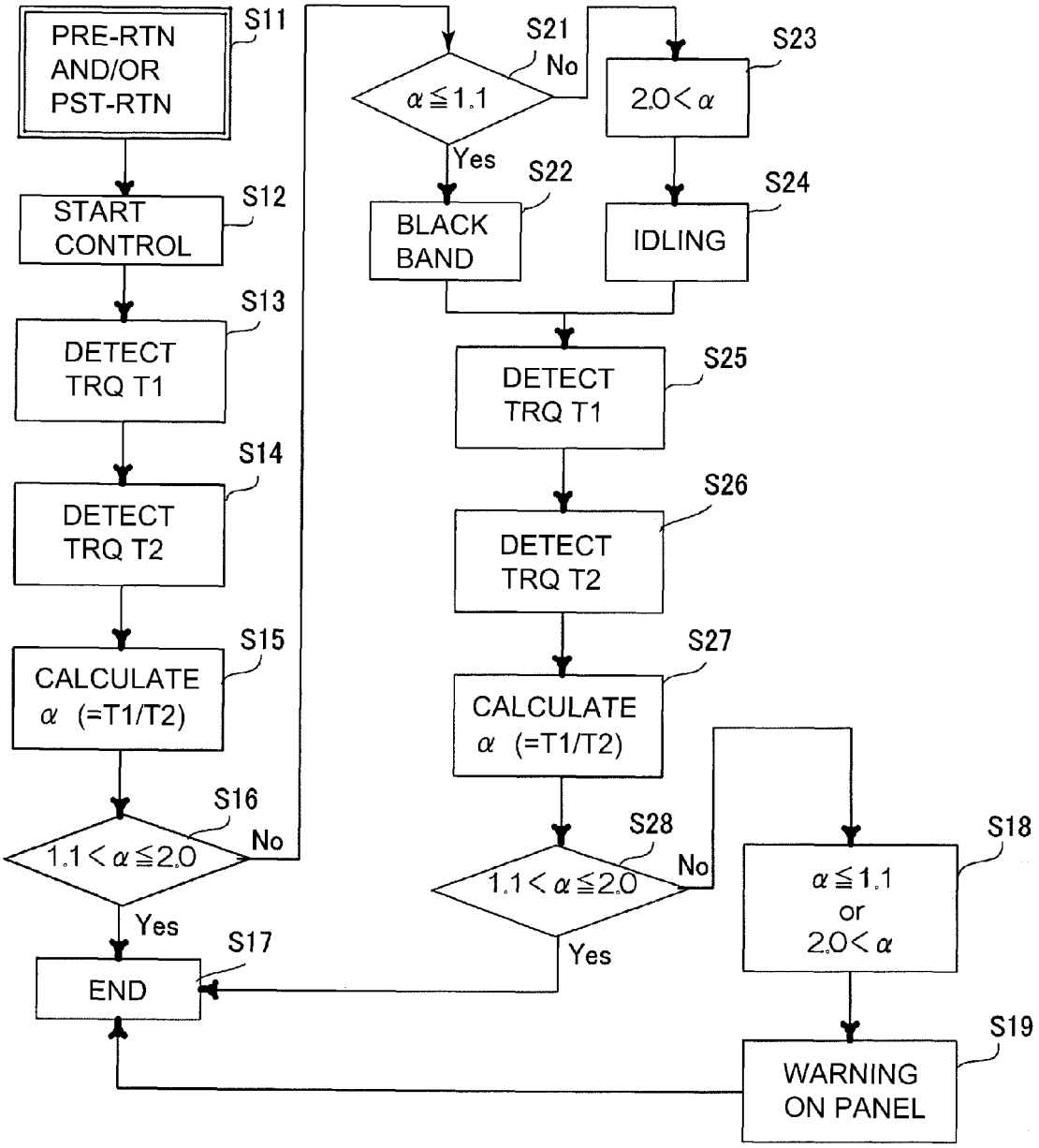

FIG. 7 is a flow chart of cleaning blade toner supply control in Embodiment 1.

Figure 8:
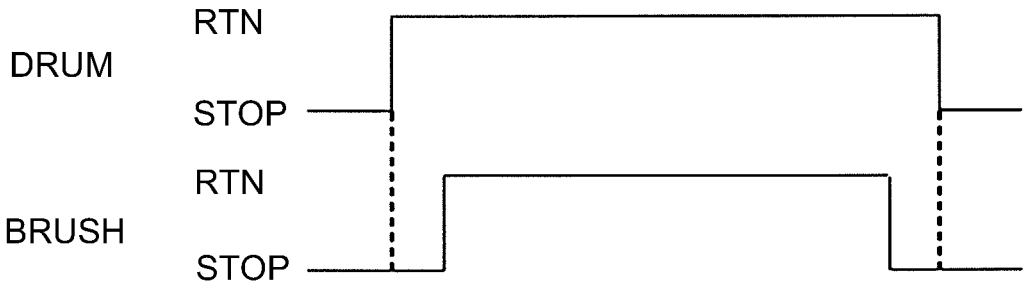

FIG. 8 is a time chart of idling of a fur brush.

Figure 9:
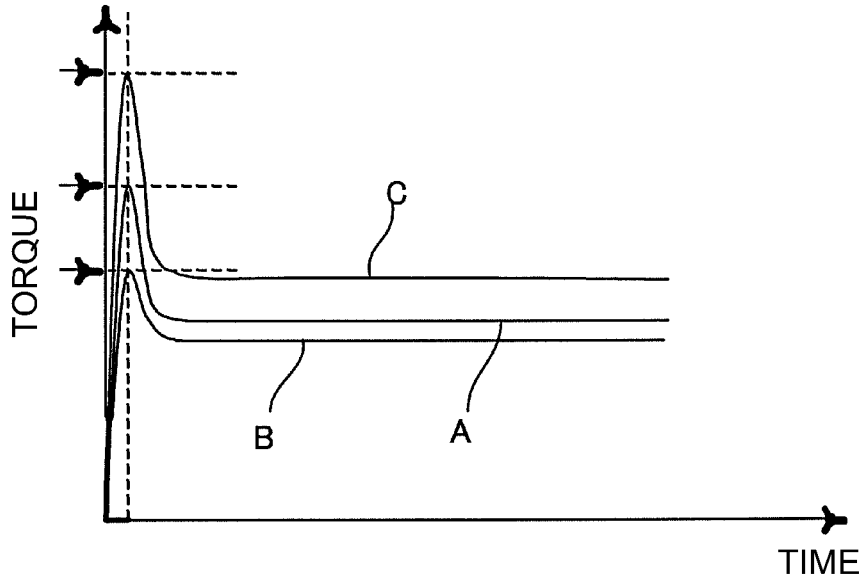
Figure 9:
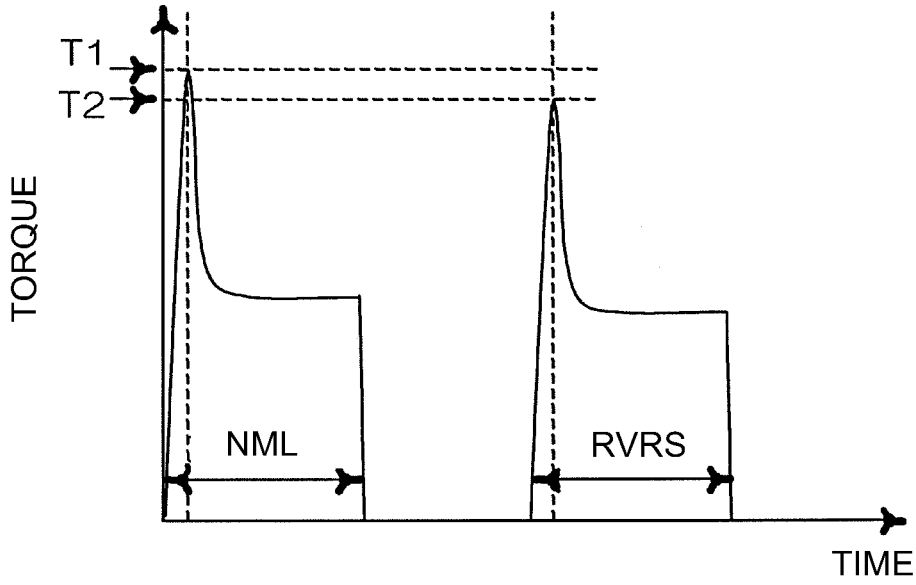

Parts (a) and (b) of FIG. 9 are illustrations of starting torques of the fur brush.

Figure 10:
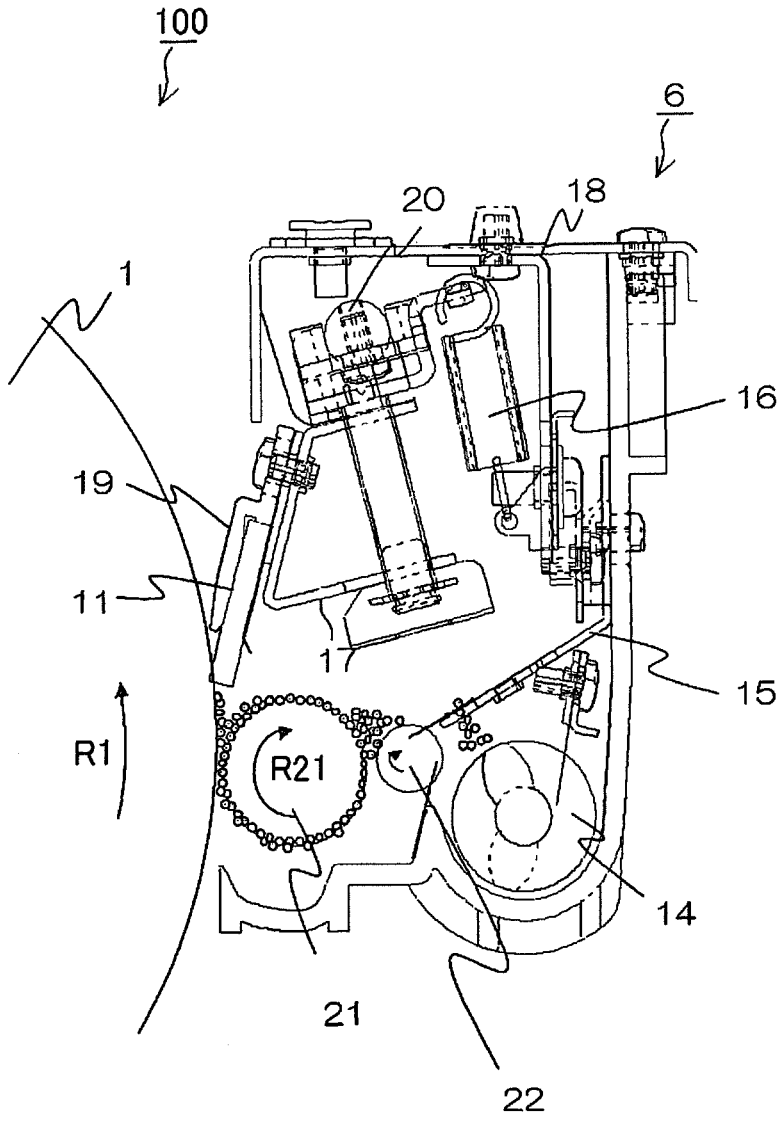

FIG. 10 is an illustration of a structure of a cleaning device in Embodiment 2.

Figure 11:
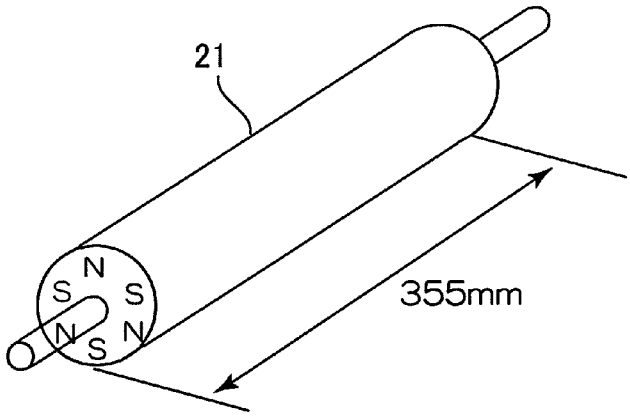

FIG. 11 is an illustration of a structure of a magnet roller in Embodiment 2.

Figure 12:
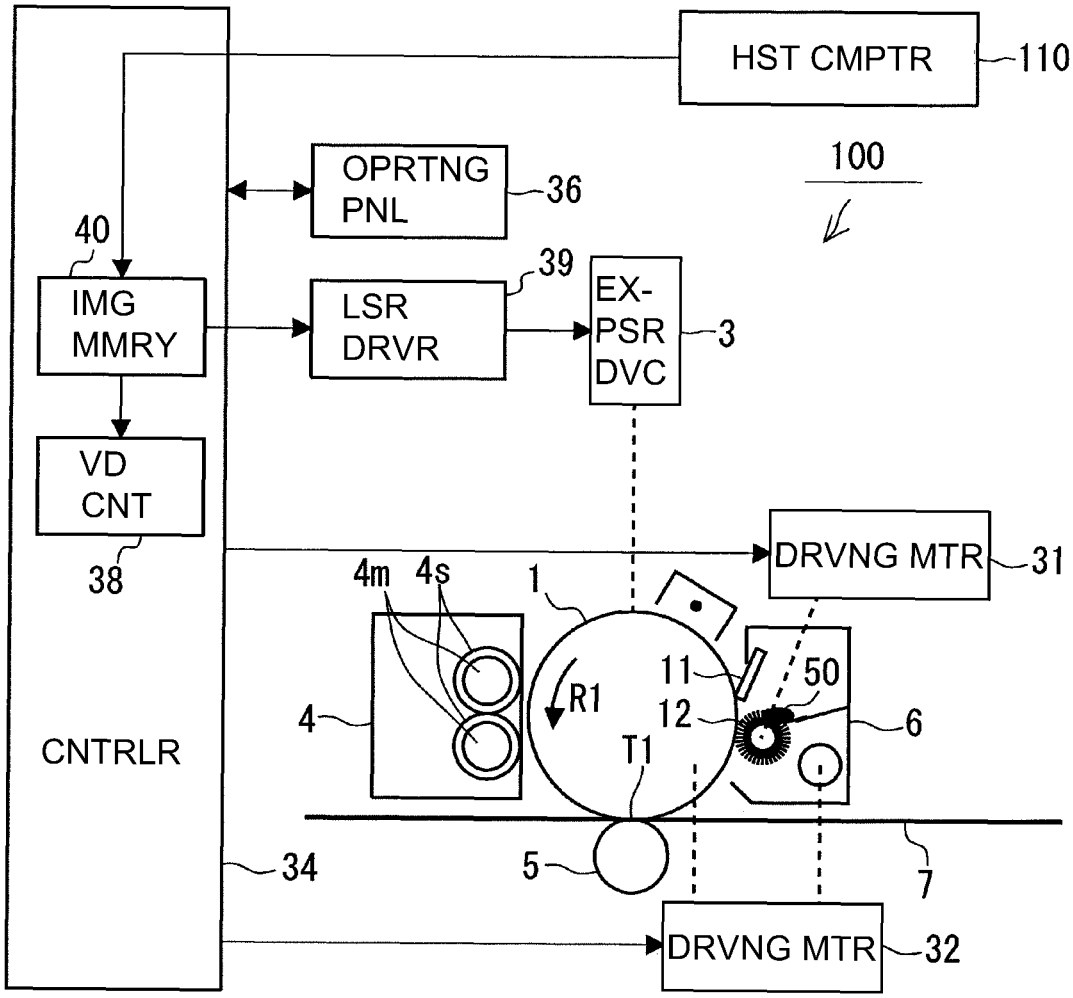

FIG. 12 is a block diagram of a control system in Embodiment 3.

Figure 13:
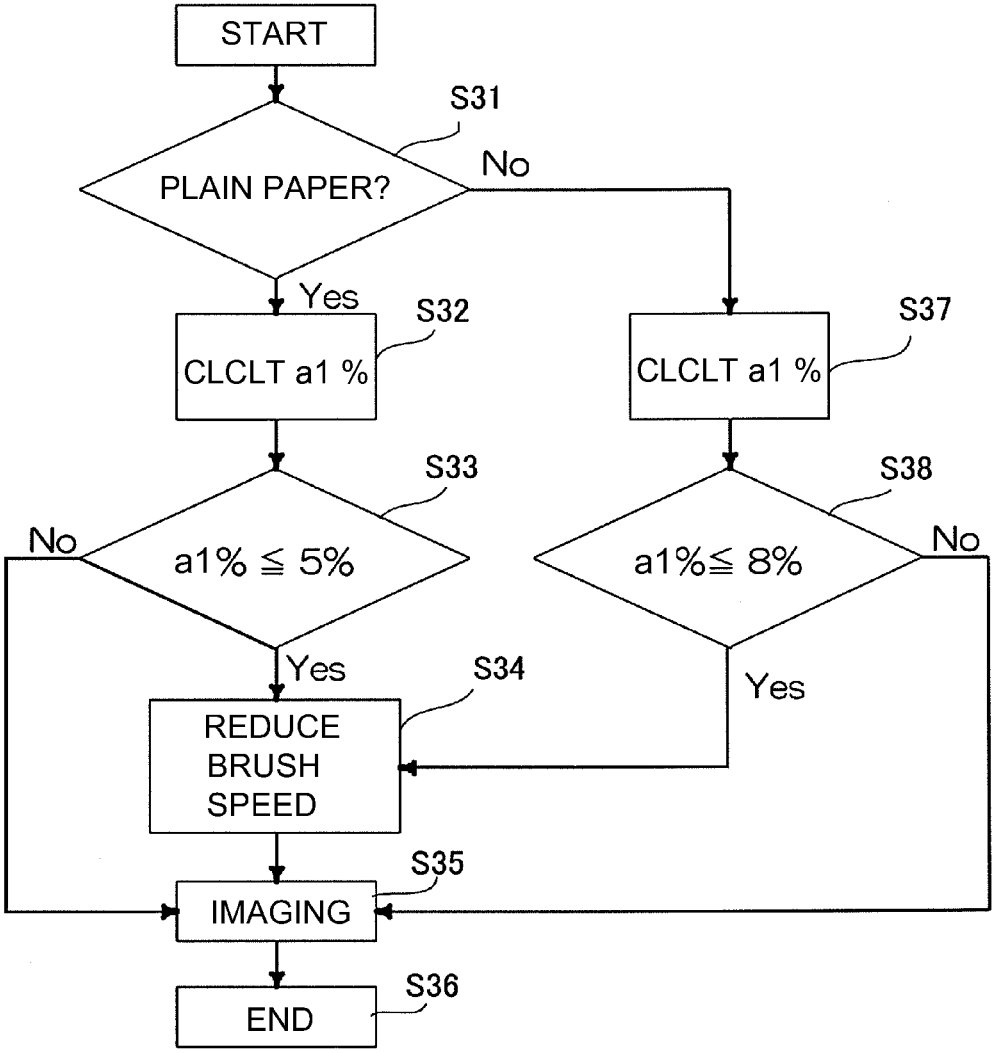

FIG. 13 is a flow chart of cleaning blade toner supply control in Embodiment 3.

Figure 14:
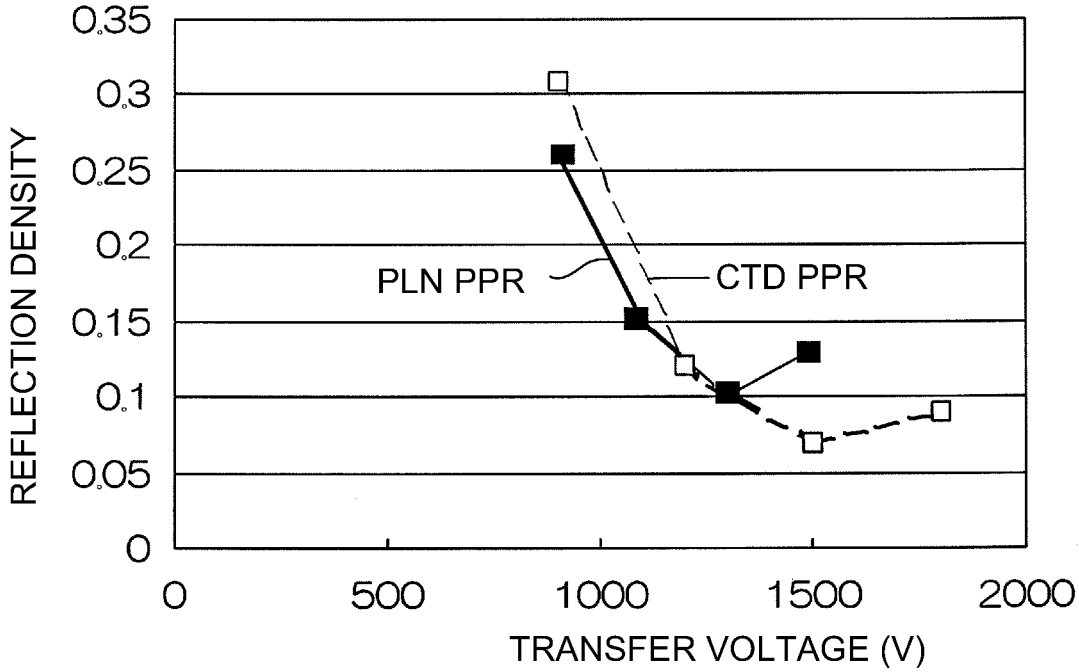

FIG. 14 is a graph showing a transfer efficiency of a toner image on each of plain paper and coated paper.

DESCRIPTION OF THE PREFERRED EMBODIMENTS

Embodiments of the present invention will be described in detail with reference to the drawings. The present invention can also be carried out in other embodiments in which a part or all of constituent elements are replaced with their alternative constituent elements so long as a toner amount in a toner sump contacted to a rotatable member is controlled.

Therefore, the present invention can be carried out irrespective of the types including a charging type of contact or non-contact, an exposure type of a laser beam or an LED array, a developing type of one-component developer or a two-component developer, and a transfer type of a monochromatic or a full color, a type of an intermediary transfer, a recording material conveyance or a direct transfer, a transfer type or a fixing type. Further, the present invention can also be carried out in any cleaning device for a photosensitive drum, an intermediary transfer belt, an intermediary transfer drum, a transfer belt and a transfer drum.

In this embodiment, only a principal part relating to toner image formation and transfer will be described but the present invention can be carried out in image forming apparatuses for various purposes such as printers, various printing machines, copying machines, facsimile machines and multi-function machines.

<Image Forming Apparatus>

Figure 1:
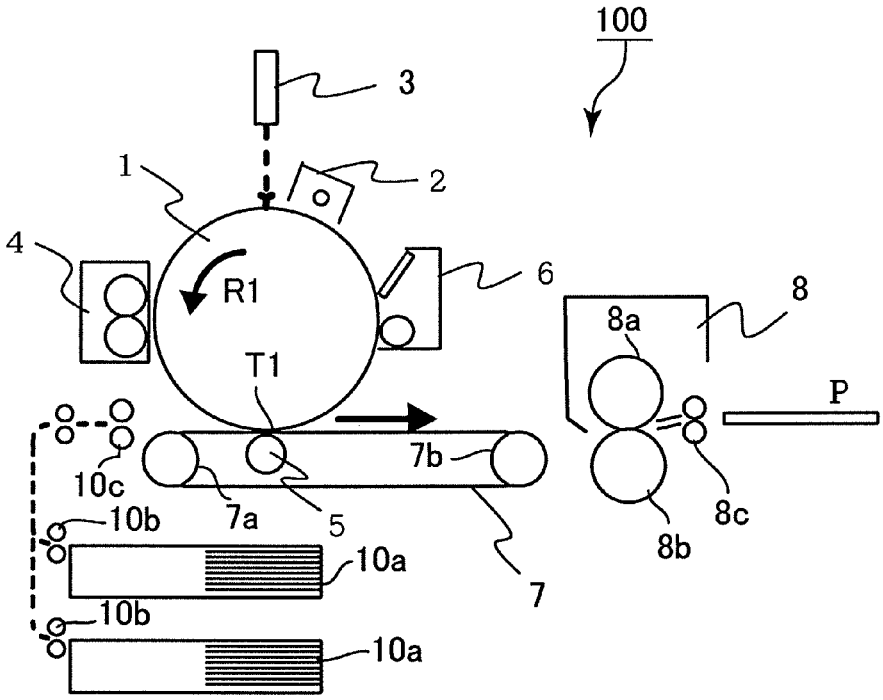
FIG. 1 is an illustration of a sectional structure of an image forming apparatus.

FIG. 1 is an illustration of a sectional structure of the image forming apparatus. As shown in FIG. 1, an image forming apparatus 100 is a monochromatic laser beam printer for transferring the toner image from a photosensitive drum 1 onto a recording material P attracted and carried on a transfer belt 7.

The image forming apparatus 100 includes, around the photosensitive drum 1, a corona charger 2, an exposure device 3, a developing device 4, a transfer roller 5 and a drum cleaning device 6.

The photosensitive drum 1 which is an example of an image bearing member is prepared by forming a layer of an organic photoconductor (OPC), which is negatively chargeable, on an outer peripheral surface of an aluminum cylinder, and is rotated in an arrow R1 direction at a process speed of 665 mm/sec. The corona charger 2 charges the surface of the photosensitive drum 1 to a uniform dark portion potential VD of a negative polarity by irradiating the surface of the photosensitive drum 1 with charged particles generated by corona discharge.

The exposure device 3 which is an example of a toner image forming means outputs a laser beam obtained by subjecting an image developed scanning line image data to ON-OFF modulation and scans the surface of the photosensitive drum 1 with the laser beam through a rotating mirror, so that an electrostatic image for an image is written (formed) on the surface of the photosensitive drum 1. The toner is deposited at a surface portion of the photosensitive drum 1 at which the surface potential is charged to a light portion potential VL by the exposure. In the developing device 4, a developer (magnetic toner) is accommodated and as shown in FIG. 6, a developing sleeve 4*s* is rotated around a fixed center magnet 4*m*. The developer is magnetically carried on the developing sleeve 4*s* and is, after being negatively charged, fed to an opposing portion where the developing sleeve 4*s* opposes the photosensitive drum 1. A so-called jumping development is performed by applying an oscillating voltage, in the form of a DC voltage biased with an AC voltage, to the developing sleeve 4*s*. As a result, the toner is deposited on the photosensitive drum 1, so that the electrostatic image is reversely developed into a toner image.

Sheets of the recording material P pulled out from a recording material cassette 10*a* are separated one by one, and the separated recording material P is fed to a registration roller 10*c*. The registration roller 10*c* sends the recording material P to the transfer belt 7 while being timed to the toner image on the photosensitive drum 1. The transfer belt 7 carries the recording material P and passes the recording material P through a transfer portion T1.

The transfer roller 5 press-contacts an inner surface of the transfer belt 7 to form the transfer portion T1 between the photosensitive drum 1 and the transfer belt 7. In a process in which the recording material P is nip-conveyed, a positive voltage is applied to the transfer roller 5, so that the toner image is transferred from the photosensitive drum 1 onto the recording material P.

The recording material P carried on the transfer belt 7 is separated at a curved surface of the transfer belt 7, rotating around a driving roller 7*b*, by curvature separation and then is sent into the fixing device 8. In the fixing device 8, a pressing roller 8*b* is pressed against a fixing roller 8*a*, which is internally heated, to form a heating nip for the recording material P. In a process in which the recording material P is nip-conveyed in the heating nip, the toner image is heat-fused on the recording material P, thus being fixed on the recording material P. The recording material P on which the toner image is fixed is discharged to the outside of a main assembly of the image forming apparatus 100 by a discharging roller 8*c*. After the toner image transfer at the transfer portion T1, untransferred toner, paper dust and another powder which remain on the surface of the photosensitive drum 1 without being transferred onto the recording material P are removed by the cleaning device 6, and the photosensitive drum 1 is then subjected to subsequent image formation.

<Cleaning Device>

Figure 2:
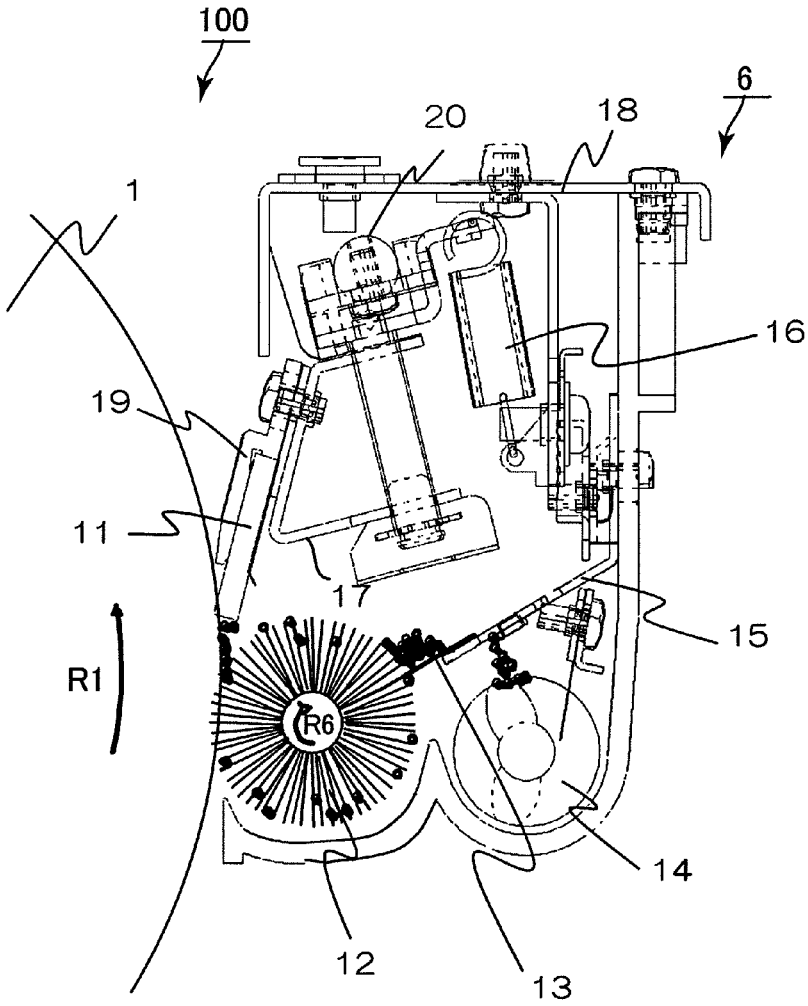
FIG. 2 is an illustration of a sectional structure of a cleaning device.

FIG. 2 is an illustration of a sectional structure of the cleaning device 6. As shown in FIG. 2, the cleaning device 6 includes, in order to further stabilize a cleaning function, a fur brush 12 as a toner supplying means provided upstream of a cleaning blade 11 with respect to the rotational direction of the photosensitive drum 1. The fur brush 12 supplies the toner removed from the surface of the photosensitive drum 1 by the cleaning blade 11 to the cleaning blade 11 again. By supplying the toner again, the toner in a substantially constant amount is always supplied uniformly to a contact portion between the photosensitive drum 1 and the cleaning blade with respect to a longitudinal direction, so that a friction coefficient between the both members is stabilized and thus a cleaning performance is stabilized.

The cleaning device 6 brings the cleaning device into contact to the surface of the photosensitive drum 1 rotating in the arrow R1 direction to remove (scrape) the untransferred toner deposited on the photosensitive drum 1. The toner removed by the cleaning blade 11 is fed to a scraper 13 by the rotation of the fur brush 12 in an arrow R6 direction. The scraper 13 separates the toner from the fur brush 12 and pushes up most of the toner onto a toner guide 15. However, a part of toner passes through the scraper 13 and is moved together with the rotating fur brush 12, thus being applied onto the photosensitive drum 1 again.

The collected toner on the toner guide 15 drops, on a conveying screw 14, from a plurality of openings provided to the toner guide 15 with respect to the longitudinal direction and is collected by the conveying screw 14, at one longitudinal end, so that the thus collected toner is discharged to the outside of the cleaning device 6.

The cleaning blade 11 is formed with a plate-like elastic member of an urethane rubber or the like and is sandwiched between a frame 17 and a holder 19 by fixing the holder 19 to the frame 17 with a screw. The cleaning blade 11 is linearly contacted to the photosensitive drum 1 at its outside edge so that the cleaning blade 11 contacts the photosensitive drum 1 counterdirectionally to the movement direction (arrow R1 direction) of the surface of the photosensitive drum 1.

A contact surface of the frame 17 to the cleaning blade 11 and a contact surface of the holder 19 to the cleaning blade 11 are processed with high accuracy and are disposed with high positional accuracy. For this reason, the cleaning blade 11 is mounted so as to be contacted to the photosensitive drum 1 with high positional accuracy by the frame 17 and the holder 19.

The frame 17 is swingably mounted to a casing frame 18 via a shaft 20. In this embodiment, the frame 17 is swingable in the longitudinal direction of the photosensitive drum 1 but may also be configured so that the frame 17 is not swingable in the longitudinal direction.

A lower end portion of a tension spring 16 is connected to a part of the casing frame 18 and an upper end portion of the tension spring 16 is mounted to a part of the swingable frame 17. Therefore, the tension spring 16 urges the frame 17, about the shaft 20, toward a direction in which the frame 17 is rotated in an arrow 17 direction. The tension spring 16 urges the frame 17 in a direction in which the cleaning blade is protruded toward the photosensitive drum 1, so that the outside edge of the cleaning blade 11 is contacted to the photosensitive drum 1 with a proper urging force.

The casing frame 18 of the cleaning device 6 downwardly extends at a far side from the photosensitive drum 1 and extends toward the photosensitive drum 1 at its lower portion.

At standing longitudinal end portions of the frame 18, end portions of each of the fur brush 12 and the conveying screw 14 are rotatably supported.

The fur brush 12 which is an example of a rotatable member slides on the photosensitive drum 1 at an upstream side of the cleaning blade 11 while carrying the toner. The fur brush 12 is, as described later, driven by a single driving motor in order to accurately measure a driving load. The conveying screw 14 is gear-connected at an end portion with respect to an axial direction and is rotationally driven by a driving motor common to the photosensitive drum 1.

The fur brush 12 is disposed upstream of the cleaning blade 11 with respect to the rotational direction of the photosensitive drum 1, and onto the surface of the fur brush 12, the untransferred toner scraped from the photosensitive drum 1 by the cleaning blade 11 is applied. The fur brush 12 has a cylindrical shape having an outer diameter of 20 mm and a length of 355 mm and has a penetration depth (entering amount), of a fur tip into the photosensitive drum 1, of 0.5 mm. A rotational speed of the fur brush 12 is 66.5 mm/sec which is 10% of a peripheral speed ratio thereof to the photosensitive drum 1, and a rotational direction is the same as that of the photosensitive drum 1.

<Toner Sump>

Parts (a) and (b) of FIG. 3 are illustrations of a toner sump, in which (a) shows a normal state and (b) shows an excessive small amount state (depletion state).

As shown in (a) of FIG. 3, the scraper 13 which is an example of a separating mechanism separates an excessive toner from the fur brush 12 while forming a toner sump 50, between itself and the fur brush 12, for supplying the toner to the fur brush 12 which is the example of the rotatable means. In this embodiment, an area on the scraper 13 functions as a toner sump at which the toner sump 50 is formed.

The untransferred toner scraped off the photosensitive drum 1 by the cleaning blade 11 is fed to the toner sump 50 formed between the fur brush 12 and the scraper 13. The toner sump 50 is in a state in which the toner in a substantially constant amount is accumulated, and the toner in the toner sump 50 is supplied little by little to the surface of the fur brush 12, so that the toner is coated again on the surface of the photosensitive drum 1 via the fur brush 12. The toner which is coated again on the photosensitive drum surface is then scraped again from the photosensitive drum 1, so that the toner is collected by the fur brush 12 and then is fed to the toner sump 50 again.

For that reason, at the contact portion between the photosensitive drum 1 and the cleaning blade 11, the toner in a constant amount is always supplied and thus the frictional coefficient is stabilized, so that a stable cleaning performance of the cleaning blade 11 is ensured. An application amount of the toner to the photosensitive drum 1 by the fur brush 12 is regulated by the penetration depth of the scraper 13 into the fur brush 12.

On the other hand, in the case where the fur brush 12 is demounted and the untransferred toner is directly scraped by the cleaning blade 11, the following inconvenience is caused. A frictional force between the cleaning blade 11 and the photosensitive drum 1 is largely different between a portion of the photosensitive drum 1 where the untransferred toner is deposited and a portion of the photosensitive drum 1 where the untransferred toner is not deposited. For this reason, when there is non-uniformity of a deposition state of the untransferred toner along the edge of the cleaning blade 11, the cleaning blade 11 is liable to cause abnormal noise, shuddering and turning-up.

The fur brush 12 uniformly recoats the surface of the photosensitive drum 1 by bringing the toner into contact to the photosensitive drum 1 in a dispersion state with respect to the longitudinal direction (along a generating line), so that the toner is recoated uniformly on the surface of the photosensitive drum 1. By the recoating of the toner on the photosensitive drum 1 with respect to the longitudinal direction, the frictional force between the cleaning blade 11 and the photosensitive drum 1 is stabilized, so that it is possible to prevent the abnormal noise and the turning-up of the cleaning blade 11.

As shown in (a) of FIG. 3, the untransferred toner is scraped together with the recoated toner by the cleaning blade 11 and is collected by the fur brush 12 to form the toner sump 50.

However, in the case where an image with a low image ratio or paper requiring a high transfer efficiency is subjected in a large amount to continuous printing, the toner amount is liable to be (collected toner amount)<<(supplied toner amount). In this case, as shown in (b) of FIG. 3, the toner in the toner sump 50 is used up and thus there is a possibility that the toner in a necessary amount cannot be supplied to the contact portion between the photosensitive drum 1 and the cleaning blade 11. In the case where the toner in the necessary amount cannot be supplied, the turning-up or breakage of the cleaning blade 11 occurs, so that there is a possibility that improper cleaning appears on an output image.

Particularly, in the image forming apparatus 100 for the market of commercial printing (POD), the image forming apparatus 100 is required to meet a wide variety of types of the paper. Thus, from the viewpoint of high image quality, the toner amount per unit area of very thin paper or coated paper is made lower than that of plain paper in some cases.

In these cases, the amount of the untransferred toner conveyed to the cleaning device 6 is decreased compared with the case of the plain paper and therefore the toner supply to the contact portion between the photosensitive drum 1 and the cleaning blade 11 becomes unstable. As a result, the turning-up or breakage of the cleaning blade can be accelerated.

Therefore, in the case where the image with the low image ratio or the paper requiring the high transfer efficiency is subjected in the large amount to the continuous printing, cleaning blade toner supply control in which a band-like toner image (so-called black band) is formed on the photosensitive drum 1 in a non-image forming area and is supplied to the cleaning device 6 is employed.

<Cleaning Blade Toner Supply Control>

In the cleaning blade toner supply control, the band like toner image (black band) is formed along the longitudinal direction of the photosensitive drum 1. By applying a voltage, to the transfer roller 5, of an opposite polarity to that during the transfer, the band like toner image passes through the transfer portion T1 without being transferred onto the transfer belt 7 and then is scraped by the cleaning blade 11 of the cleaning device 6. The toner is stagnated at the contact portion between the photosensitive drum 1 and the cleaning blade 11, so that the friction coefficient between the photosensitive drum 1 and the cleaning blade 11 is lowered.

However, the band-like toner image has a sufficient effect on the turning-up or breakage of the cleaning blade 11 but is not desirable from the viewpoints of reduction in toner consumption and prevention of toner scattering in the image forming apparatus 100. Also from the viewpoint of productivity of the image forming apparatus 100, the band-like toner image is undesirable since a frequency of interrupt control effected by interrupting an image forming job is reduced.

<Excessive Toner Amount in Toner Sump>

Parts (a) and (b) of FIG. 4 are illustrations of a toner bridging phenomenon. FIG. 5 is a graph showing a relationship between an ambient temperature and a degree of toner agglomeration. In FIG. 4, (a) shows a state in which a toner bridge is formed, and (b) shows a state in which the toner bridge grows and overflows into an area outside the cleaning device 6.

In the image forming apparatus 100 for the market of the commercial printing (POD), as described above, there is the case where the image with the high image ratio is subjected in the large amount to the continuous printing. In this case, as shown in (a) of FIG. 4, the toner bridging phenomenon such that the toner is bridged from the toner sump 50 over the toner guide 15 can occur.

The toner bridging phenomenon is liable to occur in a high temperature and high humidity environment and is such a phenomenon that the toner agglomerates on the toner guide 15 and is not dropped and thus the bridge of the toner in its literal sense is formed from the toner sump 50 over the toner guide 15. The toner guide 15 is provided with the plurality of openings along its longitudinal direction but the openings are blocked by the toner bridge. As a result, the toner is prevented from dropping onto the conveying screw 14.

When the toner bridging phenomenon occurs, in the state in which the drop of the toner from the toner guide 15 to the conveying screw 14 is prevented, the toner is sequentially supplied to the toner sump 50. As a result, finally, as shown in (b) of FIG. 4, the toner overflows from between the cleaning device 6 and the photosensitive drum 1, so that there is a possibility that the improper cleaning occurs.

As shown in FIG. 5, when the ambient temperature approaches 50° C., the degree of agglomeration of the toner is abruptly increased. For this reason, when the toner in the toner sump 50 is abnormally increased in amount and the temperature in the casing of the image forming apparatus 100 exceeds 40° C., the toner bridging phenomenon is liable to occur.

Therefore, in order to prevent the toner bridging phenomenon, in the following embodiments, the toner amount in the toner sump 50 during an operation of the image forming apparatus 100 is detected in advance and then is always adjusted at a proper level.

Embodiment 1

FIG. 6 is a block diagram of a control system in this embodiment. FIG. 7 is a flow chart of the cleaning blade toner supply control in this embodiment. FIG. 8 is a time chart of idling of the fur brush.

As shown in FIG. 6, a controller 34 which is an example of a control means estimates the toner amount in the toner sump 50 and then controls at least one of the exposure device 3 and the fur brush 12 so that the toner amount in the toner sump 50 is kept in a predetermined range. The controller 34 detects the driving load of the fur brush 12 to estimate the toner amount in the toner sump 50.

The controller 34 stops the fur brush 12 and then detects the driving load when the fur brush 12 is actuated in a direction in which the toner sump 50 is compressed. The controller 34 stops the fur brush 12 after the fur brush 12 is actuated in the direction in which the toner sump 50 is compressed, and then detects not only the driving load in the compression direction but also the driving load when the fur brush 12 is actuated in an opposite direction to the compression direction. Then, on the basis of a value obtained by dividing the driving load in the compression direction by the driving load in the opposite direction, the control is carried out. The controller 34 stops, after the fur brush 12 is stopped and then is rotated in the opposite direction, the fur brush 12 before the toner taken from the toner sump 50 reaches the photosensitive drum 1.

The controller 34 controls the exposure device 3 when the toner amount in the toner sump 50 is below the predetermined range, so that the band-like toner image is formed on the photosensitive drum 1 and is supplied to the fur brush 12. The controller 34 controls the fur brush 12 when the toner amount in the toner sump 50 exceeds the predetermined range, so that the number of rotations of the idling of the fur brush 12 is increased.

In this embodiment, information on a torque was detected from a current amount of the driving motor 31. When the forward direction of the rotation of the fur brush 12 is defined as a normal rotational direction, the fur brush 12 is rotatable both in the normal rotational direction and a reverse rotational direction opposite from the normal rotational direction. The fur brush 12 is driven by the driving motor 31 capable of changing a rotational speed.

A load detecting circuit 37 detects a supply current to the driving motor 31, thus capable of detecting a normal rotational torque and a reverse rotational torque. The controller 34 successively detects, during pre-multi-rotation and post-rotation of the image forming apparatus 100 at start of the day, a torque when the fur brush 12 is rotated in the normal rotational direction by the driving motor 31 and a torque when the fur brush 12 is rotated in the reverse rotational direction.

The controller 34 effects control in which the driving motor 31 for the fur brush 12 is rotated in the normal rotational direction and the reverse rotational direction in this order. At this time, information on the torque when the fur brush 12 is rotated in the normal rotational direction is outputted from the load detecting circuit 37 to the controller 34, so that the toner amount in the toner sump is estimated. Similarly, in formation on the torque when the fur brush 12 is rotated in the reverse rotational direction is outputted from the load detecting circuit 37 to the controller 34, so that the toner amount in the toner sump is estimated.

Thereafter, computation is performed by the controller 34 and depending on a result of the computation, the controller 34 controls the toner amount in the toner sump 50 at a proper toner amount.

As shown in FIG. 7 with reference to FIG. 6, during the pre-multi-rotation and/or the post-rotation of the image forming apparatus 100 at the start of the day (S11), the controller 34 starts the cleaning blade toner supply control (S12).

The controller 34 detects a starting torque T1 at the moment when the fur brush 12 is rotated, from a rest state, in the normal rotational direction (S13) and then stops the fur brush 12. Then, the controller 34 detects a starting torque T2 at the moment when the fur brush 12 is rotated, from the rest state, in the reverse rotational direction (S14) and then stops the fur brush 12.

The controller 34 calculates, thereafter, a ratio $\alpha$(=T1/T2) of the detected starting torque T1 to the detected starting torque T2 (S15). From the value of the ratio $\alpha$, whether or not the toner amount in the toner sump 50 is a proper amount is judged (S16).

In the case where the $\alpha$ value satisfies $1.1<\alpha<2.0$ (Yes of S16), the toner amount in the toner sump 50 is judged as being the proper amount and the operation is ended without adjusting the toner amount in the toner sump 50. However, in the case where the $\alpha$ value satisfies $\alpha<1.1$ or $2.0<\alpha$, adjustment of the toner amount in the toner sump 50 is performed.

In the case where the $\alpha$ value satisfies $\alpha\leq1.1$ (Yes of S21), the controller 34 judges that the toner amount in the toner sump 50 is excessively small and controls the exposure device 3 so as to form the band-like toner image (black and) (S22). The band-like toner image is formed in a maximum image forming area with respect to the longitudinal direction of the photosensitive drum 1 and in a length of about 200 mm with respect to a circumferential direction. At this time, a voltage is not applied to the transfer roller 5 and the recording material P is not conveyed. In this state, control is effected so that all the band-like toner is supplied to the toner sump 50 in the cleaning device 6.

In the case where the $\alpha$ value satisfies $2.0<\alpha$ (No of S21), the controller 34 judges that the toner amount in the toner sump 50 is excessive and therefore the toner is likely to be in a toner bridge state (FIG. 4), and then rotates the fur brush 12 at idle for about 1 min. At this time, when only the fur brush 12 is rotated at idle, the drop of the toner occurs and therefore, the photosensitive drum 1 is also rotated at idle together with the fur brush 12.

As shown in FIG. 8, with respect to timing of start of idling the fur brush 12 is rotated after the photosensitive drum 1 is rotated. Further, with respect to timing of end of the idling, the photosensitive drum 1 is stopped after the fur brush 12 is stopped.

Then, the controller 34 checks an adjusting effect of the toner amount in the toner sump 50. Similarly as described above, the starting torque T1 at the moment when the fur brush 12 is rotated in the normal rotational direction is detected (S25) and then the starting torque T2 at the moment when the fur brush 12 is rotated in the reverse rotational direction is detected (S26). Then, the ratio $\alpha$(=T1/T2) of the starting torque T1 to the starting torque T2 is calculated (S27).

When the $\alpha$ value satisfies $1.1<\alpha\leq2.0$ (Yes of S28), the controller 34 judges that the toner amount in the toner sump 50 is the proper amount and then ends the operation (S17).

However, in the case where the $\alpha$ value satisfies again $\alpha<1.1$ or $2.0<\alpha$ (No of S28), the controller 34 judges that it is difficult to adjust the toner amount in the toner sump 50 (S18) and displays warning on an operating panel 36 (S19). In this case, a user replaces the cleaning device 6 by himself (herself) or there is a need to contact with a service person so as to replace the cleaning device 6.

Incidentally, in Embodiment 1, the rotational speed of the fur brush 12 when the starting torques T1 and T2 were measured was set at 66.5 mm/sec which was the speed during a normal image forming operation. The rotation time was set at 3.0 sec which was shorter than a time until the toner in the toner sump 50, in the case where the fur brush 12 was reversely rotated, reaches the surface of the photosensitive drum 1.

Further, in this embodiment, the driving motor 31 for the fur brush 12 is stopped before the toner in the toner sump 50 reaches the surface of the photosensitive drum 1. This is because the scattering and drop of the toner can be prevented in this case.

<Fluctuation in Torque During Starting Torque Measurement>

Parts (a) and (b) of FIG. 9 are illustrations of starting torques of the fur brush, in which (a) shows a comparison with respect to the toner amount in the toner sump, and (b) shows a comparison between the starting torques during the normal rotation and the reverse rotation.

As shown (a) of FIG. 9, in the case where the fur brush 12 is rotated in the normal rotational direction, a torque fluctuation pattern at the time of start of the driving motor 31 varies depending on the toner amount in the toner sump. A solid line A represents the case where the toner amount in the toner sump 50 is the proper amount. A solid line B represents the case where the toner amount in the toner sump 50 is excessively small. A solid line C represents the case where the toner amount in the toner sump 50 is excessively accumulated in the toner sump 50. Depending on a difference in toner amount in the toner sump 50, a magnitude of a torque peak varies.

The torque of the driving motor 31 for the fur brush 12 becomes maximum at the moment when the state of the fur brush 12 is switched from a rest state to an operation state and then is kept at a substantially constant value when the rotation is started. When the state of the fur brush 12 is transferred from the rest state to the operation state, the load is most exerted on the fur brush 12. At this moment, a peak of the torque appears. This is because the toner in the toner sump 50 acts as a resistance to the rotation of the fur brush 12. Therefore, the peak value becomes smaller with a smaller amount of the toner in the toner sump 50 and becomes larger with a larger amount of the toner in the toner sump 50.

As shown in (b) of FIG. 9, the torque fluctuation of the driving motor 31 occurs with start of the fur brush 12. The starting torques T1 and T2 are maximum values of the torques at the moment when the fur brush 12 is actuated. The maximum value during the normal rotation of the fur brush 12 was T1 and the maximum value during the reverse rotation of the fur brush 12 was T2. In the case where the fur brush 12 is rotated in the normal rotational direction, the fur brush 12 compresses the toner sump 50 toward the scraper 13 and therefore a large peak of the torque T1 appears. However, in the case where the fur brush 12 is rotated in the reverse rotational direction, the toner in the toner sump 50 little acts as the resistance to the fur brush 12 and therefore the large peak of the torque T2 does not appear.

As described above, the toner amount is detected in advance from the value of the ratio $\alpha$ of the starting torque T1 during the normal rotation of the fur brush 12 to the starting torque T2 during the reverse rotation of the fur brush 12, so that the toner amount is adjusted at the proper amount. As a result, the cleaning property of the photosensitive drum 1 can be kept satisfactorily for a long term.

Embodiment 2

FIG. 10 is an illustration of a structure of a cleaning device in this embodiment. FIG. 11 is an illustration of a structure of a magnet roller in this embodiment.

In this embodiment, the rotatable member of the cleaning device is the magnet roller different from the fur brush in Embodiment 1. Further, in this association, the separating mechanism is a doctor roller 22 different from the scraper in Embodiment 1. Other constituent elements are similar to those in Embodiment 1 and therefore the constituent elements common to Embodiments 1 and 2 are represented by common reference numerals or symbols, thus being omitted from redundant description.

As shown in FIG. 10, in this embodiment, the magnet roller 21 performs the same function as that of the fur brush 12 in Embodiment 1 and therefore rotates at the upstream side of the cleaning blade 11 while carrying the toner thereon. Further, the thickness of the toner layer on the surface of the magnet roller 21 is regulated by an opposite between the magnet roller 21 and the doctor roller 22 which rotates counterdirectionally to the magnet roller 21 and guides the toner to the toner guide 15.

The doctor roller 22 is constituted by a non-magnetic round bar and the toner sump 50 is formed at a recessed gap portion between the magnet roller 21 and the doctor roller 22. The toner sump 50 performs an important function such that the amount of the toner coated on the surface of the magnet roller 21 is stabilized and finally the toner is recoated uniformly on the surface of the photosensitive drum 1.

The doctor roller 22 is 8 mm in outer diameter and 0.665 mm/sec in rotational speed and is rotated in an opposite direction to that of the magnet roller 21.

A gap between the photosensitive drum 1 and the magnet roller 21 is 1200 μm and a gap between the magnet roller 21 and the doctor roller 22 is 1400 μm.

As shown in FIG. 11, the magnet roller 21 is 18.8 mm in outer diameter and 355 mm in length. A polarity structure is an isotropic 6 pole symmetrical and at the surface of the magnet roller 21, magnetic flux density is 75 mT at all the magnetic pole positions. The rotational speed is 66.5 mm/sec which is 10% of the peripheral speed ratio to the photosensitive drum 1, and the rotational direction is the same direction as that of the photosensitive drum 1 at an opposing portion to the photosensitive drum 1.

In this embodiment, similarly as in Embodiment 1, the starting torque T1 of the magnet roller 21 with respect to the normal rotational direction and the starting torque T2 of the magnet roller 21 with respect to the reverse rotational direction are measured. Then, the value of the ratio $\alpha$=(starting torque T1)/(starting torque T2) is obtained to detect the toner amount in the toner sump 50 in advance, and the toner amount in the toner sump 50 is adjusted in the proper range by the band-like toner image or the idling of the fur brush 12. As a result, the photosensitive drum 1 cleaning property can be satisfactorily maintained for a long term.

Incidentally, in order to accurately measure the peak of the starting torque during the normal rotation, it is desirable that the toner sump is statically compressed and therefore the rotation of the doctor roller 22 is stopped during the measurement of the starting torque of the magnet roller 21.

Embodiment 3

FIG. 12 is a block diagram of a control system in this embodiment. FIG. 13 is a flow chart of cleaning blade toner supply control in this embodiment. FIG. 14 is a graph showing a comparison of a transfer efficiency between photosensitive drum and coated paper.

As shown in FIG. 12, the controller 34 more lowers the number of rotations per unit time of the fur brush 12 under an image forming condition in which the amount of the untransferred toner supplied to the fur brush 12 is smaller. The controller 34 more lowers the number of rotations per unit time of the fur brush 12 under an image forming condition in which the recording material requiring a higher transfer efficiency.

In this embodiment, the schematic structures of the image forming apparatus 100 and the cleaning device 6 are similar to those in Embodiment 1. In this embodiment, the rotational speed of the fur brush 12 in the develop 6 is changed depending on the image ratio, so that the toner amount in the toner sump 50 is always adjusted at the proper amount.

The image forming information sent from a host computer 110 is developed into an image memory portion 40 of the image forming apparatus 100. The image data developed in the image memory portion 40 is sent to a laser driving portion 39 in synchronism with image formation timing, so that the electrostatic image is formed on the photosensitive drum 1 on the basis of the image data.

Thereafter, by a video count 38 for development, the image ratio a1% of the image for one sheet is calculated. The image ratio is an integrated value of the density of the whole image for one sheet when the whole surface image with a maximum density 255/255 (solid black) is defined as the image ratio of 100% and the whole surface image with a minimum density of 0/255 (solid white) is defined as the image ratio of 0%. That is, the image ratio is a numerical value (toner print ratio) indicating that what % of the toner to the whole surface image with the maximum density 255/255 (solid black) is used for the resultant image.

The controller 34 controls the driving motor 31 depending on the calculated image ratio a1% to set the rotational speed of the fur brush 12. The controller 34 switches the rotational speed of the fur brush 12 with a threshold of a predetermined image ratio i % to adjust the toner amount in the toner sump 50, so that the toner is uniformly recoated on the surface of the photosensitive drum 1.

The controller 34 compares, when the image formation is effected, the image ratio a1% of the one sheet image calculated by the video count 38 with the predetermined image ratio i%. In the case of a1>i, the rotational speed of the fur brush 12 is lowered by the controller 34, so that the toner amount in the toner sump 50 is controlled so as to become the proper amount. However, in the case of a1>i, the rotational speed of the fur brush 12 is not changed, so that the fur brush 12 is continuously driven at the same rotational speed.

In this embodiment, in the case where the recording material P is the plain paper, with the threshold image ratio of 5%, the rotational speed of the fur brush 12 is lowered. This is based on an experimental result such that the band-like toner image is not formed when the image formation is continuously effected on the plain paper with the image ratio of 5% or more under the cleaning blade toner supply control in Embodiment 1. That is, in the case of a1%<5%, the toner amount in the toner sump 50 first becomes minimum and therefore in that case, the rotational speed of the fur brush 12 is lowered, so that the toner amount in the toner sump 50 is saved.

In this embodiment, in the case where the recording material P is paper (coated paper) other than the plain paper, the rotational speed of the fur brush 12 is lowered with the threshold image ratio of 8%. This is because the transfer efficiency on the cleaning device (recording material) is higher than that on the plain paper and therefore in the image formation with the same image ratio, the amount of the toner as the untransferred toner which passes through the transfer portion T1 to reach the fur brush 12 is decreased. In the case of the coated paper, in order that the untransferred toner reaches the fur brush 12 similarly as in the case of the plain paper, there is a need to form the image with a high image ratio a1% at which the toner is used in a larger amount.

As shown in FIG. 13 with reference to FIG. 12, the controller 34 judges whether or not the type of the recording material P selected by the user is the plain paper (S31). Then, by the video count 38 for development, the image ratio a1% of the image for one sheet is calculated (S32, S37).

Here, in the case where the recording material P is the plain paper (Yes of S31), the calculated a1% and the image ratio of 5% are compared (S33). In the case of the image ratio a1%>5% (No of S33), the rotation number of the fur brush 12 is not lowered. However, in the case of the image ratio a1%<5% (Yes of S33), the rotation number of the fur brush 12 is lowered by the driving motor 31. In this embodiment, the rotational speed of the fur brush 12 is lowered from the initial set value of 66.5 mm/sec to 6.65 mm/sec.

On the other hand, in the case where the recording material P is the predetermined other than the plain paper (No of S31), the calculated a1% and the image ratio of 8% are compared (S38). In the case of the image ratio a1%>8% (No of S38), the rotation number of the fur brush 12 is not lowered. However, in the case of the image ratio a1%≤8% (Yes of S38), the rotation number of the fur brush 12 is lowered by the driving motor 31. In this embodiment, similarly as in the case of the plain paper, the rotational speed of the fur brush 12 is lowered from the initial set value of 66.5 mm/sec to 6.65 mm/sec.

Thereafter, when the image formation on the first sheet is ended (S35), the value of the image ratio a1% is reset. In the case where the image is continuously formed on the second sheet, the above operation is repeated. Incidentally, in this embodiment, the calculation of the image ratio a1% is performed every sheet but the fur brush rotational speed may also be adjusted with timing for each predetermined number of sheets for which the image ratios are averaged.

The relationship between a transfer voltage and a reflection density (untransferred toner amount) with respect to the plain paper and the cleaning device is shown in FIG. 14. The ordinate represents the reflection density measured after the untransferred toner on the photosensitive drum 1 is separated with a tape, and the abscissa represents the transfer voltage. The higher reflection density means that the transfer efficiency is lower and the amount of the untransferred toner is larger. Therefore, in the case of the recording material P providing a very high transfer efficiency, there is a need to change the threshold image ratio a1%, to a proper value, at which the rotational speed of the fur brush 12 is switched. The reflection density of the untransferred toner on the plain paper is about 1.5 times that on the coated paper and therefore from this result, the threshold image ratio value of 8% for the coated paper is determined on the basis of the threshold image ratio value of 5% for the plain paper.

Table 1 shows a relationship among the image ratio, the rotational speed of the fur brush 12 and an effect in the cleaning blade toner supply control in this embodiment.

TABLE 1

| | Image ratio | |
|---|---|---|
| | Low | High |
| FBRS*1 | Decreased | Increased |
| Effect | TUP*2 | BP*3 |

*1"FBRS" represents the fur brush rotational speed.
*2"TUP" represents turning-up prevention.
*3"BP" represents bridge prevention.

As shown in Table 1, in the case where the image with the low image ratio is continuously formed, the rotational speed of the fur brush 12 is decreased and thus even when the band-like toner image is not formed, it is possible to obtain the effect of sufficiently preventing the turning-up of the cleaning blade 11. On the other hand, in the case where the image with the high image ratio is continuously formed, the rotational speed of the fur brush 12 is increased, so that it is possible to prevent the toner bridge.

Table 2 shows a result of study on setting of the rotational speed of the fur brush 12 in the cleaning blade toner supply control in Embodiment 3.

TABLE 2

| | FBRS*1 (mm/sec) | | | |
|---|---|---|---|---|
| | 6.65 | 13.3 | 33.3 | 66.5 |
| TAITC*2 | ○ | Δ | x | x |

*1"FBRS" represents the fur brush rotational speed.
*2"TAITC" represents the toner amount in the toner sump.
"○" represents no toner depletion.
"Δ" represents that the toner is somewhat depleted.
"x" represents a poor level.

As shown in Table 2, the rotational speed of the fur brush 12 was changed and a state of the change in toner amount in the toner sump 50 at that time was evaluated. The evaluation was effected in the following manner. In a state the toner sump 50 in which the toner was accumulated in a proper amount is formed, the developing device 4 was demounted and then the image forming apparatus 100 was rotated at idle for 5 min. Thereafter, the state of the toner sump 50 after the idling was checked by eye observation. As shown in Table 2, in the image forming apparatus 100, even in the case where the image with the image ratio of 0% is continuously formed, the rotational speed of the fur brush 12 is set at 6.65 mm/sec or less. As a result, it was possible to confirm that the toner supply to the cleaning blade 11 can be continued while avoiding the depletion of the toner in the toner sump 50.

Further, even in the case where the whole surface image with the maximum density 255/255 (solid black) was continuously formed, it was confirmed that the occurrence of the toner bridging phenomenon can be prevented by setting the rotational speed of the fur brush 12 at the initial set value of 66.5 mm/sec.

In this embodiment, depending on the image ratio a1% of the image for one sheet, the rotational speed of the fur brush 12 is variably changed, so that the toner amount in the toner sump 50 is adjusted to stabilize recoating of the toner onto the surface of the photosensitive drum 1. As a result, the photosensitive drum 1 cleaning performance of the cleaning blade 11 can be satisfactorily maintained for a long term.

Embodiment 4

In Embodiments 1 to 3, as the rotatable member for supplying the contact portion of the cleaning blade 11, the fur brush and the magnetic roller are described. However, the rotatable member is not limited to these members but may also be a rubber roller or the like.

Further, in Embodiments 1 to 3, the case where the photosensitive drum 1 is used as a member to be cleaned by the cleaning device 6 is described. However, in the image forming apparatus of the intermediary transfer type, a similar effect can also be obtained in the case where the member to be cleaned by the cleaning device 6 is the intermediary transfer roller.

Further, in Embodiments 1 to 3, a discriminating condition of the starting torque ratio $\alpha=T1/T2$ is based on the constitution in Embodiment 1. However, in the case where the constitution of the cleaning device 6 or the type of the toner is different, the toner amount in the toner sump 50 is detected in advance by changing the threshold of the discriminating condition, so that it is possible to adjust the toner amount in the toner sump 50 at the proper amount.

Further, as described in Embodiment 3, it is also possible to carry out the control in Embodiment 1 and the control in Embodiment 3 in parallel. In this case, the toner amount in the toner sump is restored to the predetermined range by the control in Embodiment 1 during the pre-multi-rotation at start of the day and during the post-rotation while avoiding the depletion of the toner in the toner sump during the continuous image formation by the control in Embodiment 3.

In any case, the object in the embodiments of the present invention is to stabilize the toner amount in the toner sump in the cleaning device 6 during the image forming operation to satisfactorily maintain the photosensitive drum 1 cleaning property for a long term.

As described above, according to the image forming apparatus of the present invention, the toner amount in the toner sump is kept in the predetermined range and the toner is stably supplied to the image bearing member via the rotatable member, so that the toner is stably supplied to the end of the cleaning blade via the image bearing member. The toner amount in the toner sump spaced apart from the image bearing member and the cleaning is estimated in advance and therefore the estimation result is not influenced by the cumulative operating time of the image bearing member and the cleaning blade, so that the estimation result is also less influenced by the ambient temperature and humidity.

Therefore, even when the cumulative operating time of the image bearing member and the cleaning blade is changed, the cleaning effect of the cleaning blade can be stably maintained.

While the invention has been described with reference to the structures disclosed herein, it is not confined to the details set forth and this application is intended to cover such modifications or changes as may come within the purpose of the improvements or the scope of the following claims.

This application claims priority from Japanese Patent Application No. 174548/2010 filed Aug. 3, 2010 which is hereby incorporated by reference.

What is claimed is:

1. An image forming apparatus comprising:

an image bearing member;

toner image forming means for forming a toner image on said image bearing member;

transfer means for transferring the toner image from said image bearing member onto a transfer material;

a cleaning blade for removing a toner remaining on said image bearing member after the toner image is transferred while in contact with said image bearing member;

a rotatable member, provided upstream of said cleaning blade, for carrying the toner and rotationally sliding on said image bearing member;

a separating mechanism for removing the toner from said rotatable member, the separating mechanism is disposed in contact with said rotatable member, wherein said separating mechanism includes a toner sump for accumulating the toner in an area adjacent to said rotatable member so that the toner removed from said rotatable member is suppliable to said rotatable member; and control means for controlling at least one of said toner image forming means and said rotatable member so that an amount of the toner in the toner sump is estimated and kept in a predetermined range, wherein said control means detects a driving load of said rotatable member during non-image formation and estimates the amount of the toner in the toner sump.

2. An apparatus according to claim 1, wherein said control means controls, when the amount of the toner in the toner sump is less than a predetermined range, said toner image forming means to form a banded toner image on said image bearing member and then supplies the band-like toner image to said rotatable member.

3. An apparatus according to claim 1, wherein said control means controls, when the amount of the toner in the toner sump exceeds a predetermined range, said rotatable member to increase the number of rotations of idling of said rotatable member during non-image formation.

4. An apparatus according to claim 1, wherein said control means more reduces the number of rotations per unit time of said rotatable member with an image forming condition in which an amount of an untransferred toner supplied to said rotatable member is smaller.

5. An image forming apparatus comprising:

an image bearing member;

toner image forming means for forming a toner image on said image bearing member;

transfer means for transferring the toner image from said image bearing member onto a transfer material;

a cleaning blade for removing a toner remaining on said image bearing member after the toner image is transferred while in contact with said image bearing member;

a rotatable member, provided upstream of said cleaning blade, for carrying the toner and rotationally sliding on said image bearing member;

a separating mechanism for removing the toner from said rotatable member, the separating mechanism is disposed in contact with said rotatable member, wherein said separating mechanism includes a toner sump for accumulating the toner in an area adjacent to said rotatable member so that the toner removed from said rotatable member is suppliable to said rotatable member; and control means for controlling at least one of said toner image forming means and said rotatable member so that an amount of the toner in the toner sump is estimated and kept in a predetermined range, wherein said control means stops said rotatable member and detects a driving load when said rotatable member is actuated in a direction in which in the toner sump is compressed.

6. An image forming apparatus comprising:

an image bearing member;

toner image forming means for forming a toner image on said image bearing member;

transfer means for transferring the toner image from said image bearing member onto a transfer material;

a cleaning blade for removing a toner remaining on said image bearing member after the toner image is transferred while in contact with said image bearing member;

a rotatable member, provided upstream of said cleaning blade, for carrying the toner and rotationally sliding on said image bearing member;

a separating mechanism for removing the toner from said rotatable member, the separating mechanism is disposed in contact with said rotatable member, wherein said separating mechanism includes a toner sump for accumulating the toner in an area adjacent to said rotatable member so that the toner removed from said rotatable member is suppliable to said rotatable member; and control means for controlling at least one of said toner image forming means and said rotatable member so that an amount of the toner in the toner sump is estimated and kept in a predetermined range, wherein said control means stops said rotatable member after said rotatable member is actuated in a direction in which the toner sump is compressed, and then detects not only a driving load in a compression direction but also the driving load when said rotatable member is actuated in an opposite direction to the compression direction, and wherein said control means effects the control on the basis of a value obtained by dividing the driving load in the compression direction by the driving load in the opposite direction.

7. An image forming apparatus comprising:

an image bearing member;

toner image forming means for forming a toner image on said image bearing member;

transfer means for transferring the toner image from said image bearing member onto a transfer material;

a cleaning blade for removing a toner remaining on said image bearing member after the toner image is transferred while in contact with said image bearing member;

a rotatable member, provided upstream of said cleaning blade, for carrying the toner and rotationally sliding on said image bearing member;

a separating mechanism for removing the toner from said rotatable member, the separating mechanism is disposed in contact with said rotatable member, wherein said separating mechanism includes a toner sump for accumulating the toner in an area adjacent to said rotatable member so that the toner removed from said rotatable member is suppliable to said rotatable member; and control means for controlling at least one of said toner image forming means and said rotatable member so that an amount of the toner in the toner sump is estimated and kept in a predetermined range, wherein said control means stops, after said rotatable member is stopped and then rotated in an opposite direction to a compression direction of the toner sump, said rotatable member before the toner taken from the toner sump by said rotatable member reaches said image bearing member.

* * * * *